US010829295B2

(12) United States Patent
Rasel et al.

(10) Patent No.: US 10,829,295 B2
(45) Date of Patent: Nov. 10, 2020

(54) SELF-CLOSING DISPENSING HEAD

(71) Applicant: BEIERSDORF AG, Hamburg (DE)

(72) Inventors: Hannah Rasel, Hamburg (DE); Ingo Malchus, Weener (DE)

(73) Assignee: BEIERSDORF AG, Hamburg (DE)

( * ) Notice: Subject to any disclaimer, the term of this patent is extended or adjusted under 35 U.S.C. 154(b) by 0 days.

(21) Appl. No.: 16/347,699

(22) PCT Filed: Oct. 18, 2017

(86) PCT No.: PCT/EP2017/076544
§ 371 (c)(1),
(2) Date: May 6, 2019

(87) PCT Pub. No.: WO2018/086831
PCT Pub. Date: May 17, 2018

(65) Prior Publication Data

US 2019/0283959 A1 Sep. 19, 2019

(30) Foreign Application Priority Data

Nov. 8, 2016 (DE) ..... 10 2016 221 820

(51) Int. Cl.
*B65D 83/48* (2006.01)
*B65D 83/20* (2006.01)
*B65D 83/14* (2006.01)

(52) U.S. Cl.
CPC ..... *B65D 83/48* (2013.01); *B65D 83/205* (2013.01); *B65D 83/7535* (2013.01)

(58) Field of Classification Search
CPC ... B65D 83/48; B65D 83/205; B65D 83/7535
USPC ..... 222/402.1
See application file for complete search history.

(56) References Cited

U.S. PATENT DOCUMENTS 2,913,000 A * 11/1959 Roberts ..... F16K 15/148 137/854
3,874,563 A * 4/1975 Schwartzman .... B65D 47/2075 222/213
4,437,592 A * 3/1984 Bon ..... B65D 83/207 222/402.12
5,447,257 A * 9/1995 Dark ..... B67D 1/0456 222/336
6,257,503 B1 * 7/2001 Baudin ..... B05B 1/06 239/337
6,966,465 B2 * 11/2005 Kang, III ..... B05B 11/3001 222/321.9
7,464,839 B2 * 12/2008 Heukamp ..... B65D 83/7535 222/402.13

(Continued)

FOREIGN PATENT DOCUMENTS

DE 20209616 U1 7/2003
DE 102007044180 A1 3/2009

(Continued)

*Primary Examiner* — Paul R Durand
*Assistant Examiner* — Andrew P Bainbridge
(74) *Attorney, Agent, or Firm* — Abel Schillinger, LLP

(57) ABSTRACT

The invention relates to a self-closing dispensing head for a pressurised container having a dispensing valve for dispensing media, in particular viscous, self-foaming and/or gel-type products, the dispensing head (1) having an outlet (3) which can be closed by a closing element (6).

20 Claims, 2 Drawing Sheets

(56) References Cited

U.S. PATENT DOCUMENTS

| | | | | |
|---|---|---|---|---|
| 7,575,134 | B2 * | 8/2009 | Martin | B05B 11/007 222/494 |
| 7,891,525 | B2 * | 2/2011 | Behar | B05B 11/0029 222/153.13 |
| 9,604,773 | B2 * | 3/2017 | Verville | B65D 83/205 |
| 10,086,395 | B2 * | 10/2018 | Goettke | B05B 11/3001 |
| 2005/0103811 | A1 | 5/2005 | Heukamp | |
| 2009/0230156 | A1 | 9/2009 | Prox | |
| 2015/0360245 | A1 * | 12/2015 | Wang | B05B 11/0064 239/584 |
| 2019/0283959 | A1 * | 9/2019 | Rasel | B65D 83/48 |

FOREIGN PATENT DOCUMENTS

| | | | |
|---|---|---|---|
| EP | 1052023 | A1 | 11/2000 |
| EP | 1295812 | A1 | 3/2003 |

* cited by examiner

SELF-CLOSING DISPENSING HEAD

BACKGROUND OF THE INVENTION

1. Field of the Invention

The invention relates to a self-closing dispensing head 1 for a pressurized container having a dispensing valve for dispensing media, in particular viscous, self-foaming and/or gel-like products, wherein the dispensing head has a dispensing orifice 3 closeable by a closure element, an opening mechanism by which, in the assembled state, the dispensing valve of the pressurized container can be opened, and a channel for the medium that opens into the dispensing orifice 3, wherein the channel has a first channel segment 4 and a second channel segment 5, and wherein, by pressure on an actuation element 8, the opening mechanism is actuated and the closure element and the second channel segment 5 are also moved relative to each other in such a way that the dispensing orifice is freed.

2. Discussion of Background Information

Pressurized containers with dispensing heads of a conventional design, e.g. for shaving foams and gels, usually have a non-closeable dispensing orifice. Therefore, after use, it may often happen that the medium continues to flow or to foam despite the actuating elements no longer being activated. This leads to unsightly residual amounts which are left in the region of the dispensing orifice and which dry out and, upon renewed use, contaminate the newly dispensed fresh medium. In addition, the dispensing orifice often becomes clogged up by dried residual medium.

A further problem is the possibility of germs, water or oxygen getting into the dispensing channel, particularly if the preparation emerging from the dispensing orifice is wiped off with contaminated fingers or cloths or is washed off. In the text below, this is covered by the expression "contamination of the dispensing channel".

In order to avoid these disadvantages, a self-closing dispensing head for a pressurized container of the type mentioned at the outset is disclosed in EP 1295812 A1, in which the dispensing orifice can be closed and opened via a closure element. By pressure applied to an actuation element, the opening mechanism is actuated and the closure element and the second channel segment are also moved relative to each other. In this way, the dispensing valve is opened, such that the pressurized medium can flow into the channel. However, it can emerge via the dispensing orifice only when the closure element has freed the second channel segment. By spring means, e.g. by a partially elastically deformable housing of the dispensing head, the respective elements can be returned to their original position relative to one another and to the pressurized container as the pressure on the actuation element subsides, such that the dispensing valve and also the dispensing orifice are closed again. This effectively counteracts continued flow or continued foaming.

However, a disadvantage of this is that, as before, residual amounts of the medium to be dispensed remain in the region of the dispensing orifice. Moreover, the secure closure of the dispensing orifice causes problems. A further disadvantage is that, through the movement of the closure element into the channel (retreat of the closure element), part of the channel is freed and there is therefore a high risk of germs being able to enter the channel.

Accordingly, it is an object of the present invention to develop a self-closing dispensing head for a pressurized container, of the type mentioned at the outset, in such a way that residual amounts of the medium to be dispensed are effectively avoided and the dispensing orifice can be securely closed.

DE 102007044180 A1 likewise discloses a self-closing dispensing head with an operating principle similar to that of EP 1295812 A1. This dispensing head is mainly characterized in that the closure element is designed as a movable closure piston with centering attachments which are provided at a distance from one another on its circumferential surface and which are movable with the closure piston, wherein free regions for the through-flow of the dispensed medium are provided between the individual centering attachments. By comparison with EP 1295812 A1, this ensures that relative deviations in position from the centered position of the closure piston relative to the housing parts are safely avoided, such that the closure piston can be moved in a reproducible and precise manner to its open position and closed position. Residual amounts still remaining in the starting orifice are safely brought back into the first channel segment upon transfer of the closure piston from its open position to the closed position. The closure piston is opened by pressure that the actuation element applies to the end of the closure piston. This means that the second channel segment of the dispensing channel has to be open both at the dispensing orifice and also at the end remote from the dispensing orifice. Openings in the dispensing channel represent sites for entry of microorganisms and therefore possible contamination.

SUMMARY OF THE INVENTION

A person skilled in the art could not foresee a self-closing dispensing head for a pressurized container of the type mentioned at the outset, in which the closure element is arranged as a movable closure piston in the second channel segment, wherein the second channel segment is closed at its end remote from the dispensing orifice, and the closure piston is composed of a cylindrical and/or rod-shaped central part (hereinafter designated as cylindrical shaft), wherein at one end of the central part one or more means are attached for securing in the dispensing channel, in particular one or more barbs, and, at the end of the central part remote from the securing means, a conical and/or disk-shaped valve head is attached, which is dimensioned such that it is able to close the dispensing orifice. According to the invention, it is advantageous if securing means and the valve head are made of a material that is more easily deformable (more elastic) than the material from which the central part is made.

In order to permit a good flow from the dispensing valve of the pressurized container through the dispensing channel to the dispensing orifice, and to ensure a permanent centering of the closure piston, it is advantageous for the central part of the closure piston to be provided along the main axis with centering attachments and/or grooves or for the dispensing channel to be provided with furrow-shaped notches or with auxiliary channels arranged in parallel.

Since the assembly of a closure piston provided with centering attachments is more difficult, it is particularly preferable according to the invention to provide the dispensing channel with furrow-shaped notches (grooves) or with auxiliary channels arranged in parallel.

Within the context of the invention, furrow-shaped notches are also to be understood as cylindrical channels which adjoin the wall of the dispensing channel and are partially open to the latter, such that cylindrical furrows form in the wall of the dispensing channel.

It is also within the context of the invention to anchor the closure piston firmly in the second channel segment through form-fit engagement (clamping) between the cylindrical shaft of the closure piston and the wall of the second channel segment and by a configuration formed at the shaft of the closure piston. The valve head of the closure piston serves as self-closing element in the dispensing orifice. Such form-fit engagement, which is obtained for example by the clamping action of a cylindrical shaft produced in an oversize in relation to the diameter of the channel element, is a securing means within the context of the invention and is to be seen as an equivalent to barbs, for example.

A self-closing dispensing head for a pressurized container is thus made available with which a medium can be dispensed very cleanly.

This is due in particular to the fact that, because of the second dispensing channel being open only at one end, contamination is more difficult than in the prior art.

The residual amount is avoided both on the outside of the dispensing orifice (also corresponds to absence of continued foaming) and also inside the channels. Thus, only a very reduced fraction of medium is available to microorganisms for potential entry of germs. Moreover, the medium is dispensed without the second channel segment being freed. According to the invention, there is no piston moving back and forth, which signifies a reduced possibility of contamination with germs.

In the dispensing head according to the invention, the valve head lifts from the dispensing orifice during the dispensing, as a result of which no part of the dispensing channel is exposed.

If the valve of the pressurized container is opened by pressure on the actuation element, the medium emerging from the valve can flow via the first and second dispensing channel to the dispensing orifice. As a result of the pressure that thus builds up, the soft valve head is lifted and the medium flow out. If the actuation element is released, the pressure in the dispensing channel decreases and the valve head retreats to its starting position, as a result of which a "hermetic" closure of the dispensing channel in relation to the environment is ensured.

Only small residues of the medium to be dispensed then remain on the outer region of the dispensing orifice of the dispensing head, and the user can easily remove these residues by simple means, e.g. by simple wiping with a finger or by washing. The danger of contamination of the medium in the dispensing channel is thus safely avoided.

Since through-flow spaces are present in the dispensing channel, the dispensing of the medium is not obstructed.

To permit the assembly of the closure piston in the channel, the cylindrical shaft must have a certain stiffness. This is an important difference from the known umbrella valves of the kind that are available for example from the company Minivalve. Known umbrella valves are made entirely of an elastic material and have only a short shaft. With these, assembly over the length of the channel would not be possible, since they have insufficient stiffness to be able to be inserted (pressed) into the dispensing channel.

These closure elements are particularly suitable when the second channel element (5) has a length of 3 to 25 mm, in particular 5 to 20 mm.

It is advantageous according to the invention if the barbs and/or the valve head of the closure piston are made of a soft plastics material, e.g. TPE, silicone, LDPE. The central part of the closure piston can be made, for example, of ABS, PP or POM material, in each case hard plastics materials.

To make contamination of medium more difficult, it is advantageous that the second channel segment has, in the region of the dispensing orifice, a valve seat in which the closure piston with the sealing element can be fully accommodated in its closure position, wherein an upper region of the dispensing-side end of the closure piston is arranged at a distance from the dispensing orifice end, but otherwise no longer protrudes beyond the housing of the dispensing head in the region of the dispensing orifice. The closure piston preferably adopts its position in the valve seat such that its front end terminates flush with the outer surface of the housing, such that residues of dispensed medium on the outside can be easily removed.

Medium remaining inside the dispensing channel can be pressed back into the side channel segment via the seal and the valve seat.

The self-closing dispensing head according to the invention can be constructed from just two injection-molded parts which, while needing to have a high degree of precision, require only minimal assembly work, which leads overall to cost savings in relation to the prior art mentioned above.

BRIEF DESCRIPTION OF THE DRAWINGS

Further advantageous embodiments of the invention will become clear from further dependent claims, the description below and the drawings. In the drawings:

In the drawing, parts having basically the same function are provided with corresponding reference numbers.

DETAILED DESCRIPTION OF EMBODIMENTS OF THE INVENTION

Figure 1A:
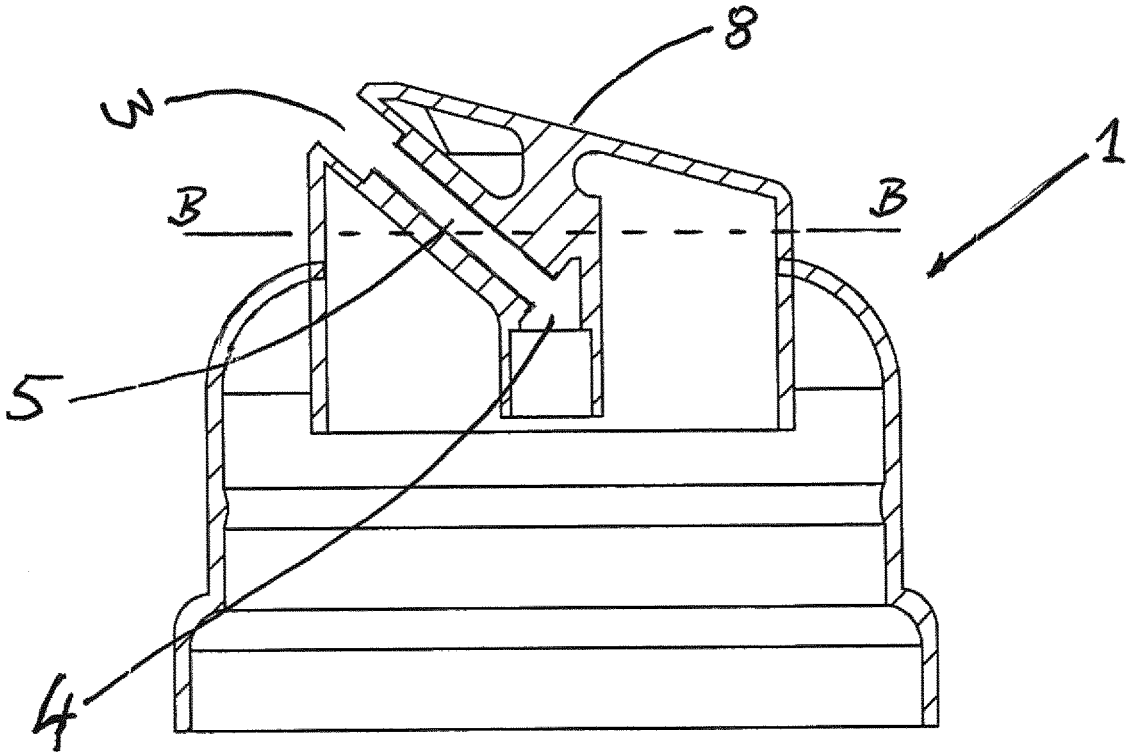
FIG. 1*a* shows an illustrative embodiment of a dispensing head without inserted closure piston.
Figure 1B:
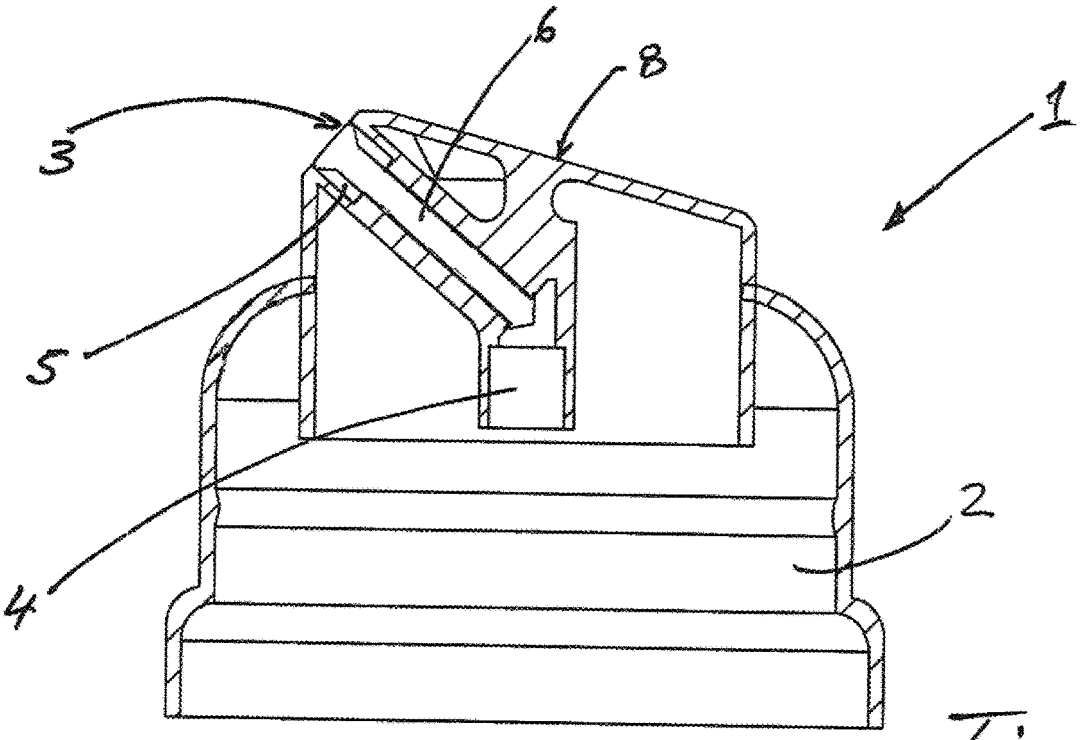
FIG. 1*b* shows an illustrative embodiment of a dispensing head with inserted closure piston.

FIG. 1 shows the dispensing head 1, which is preferably configured in one piece. It has a housing 2 which is mounted on a container and a dispensing valve (not shown in detail) for dispensing media, for example viscous, self-foaming and/or gel-like products, or is connected in one piece thereto. This dispensing valve is assigned to the inner container space, into which the medium is filled, and can be operated by an opening mechanism by pressing on the actuation surface 8 of the dispensing head.

The dispensing head has a dispensing orifice 3 which is in fluidic communication via a first channel segment 4 and a second channel segment 5. The closure element, which is configured as a closure piston 6 and closes the dispensing orifice 3, is assigned to the second channel segment.

Figure 3:
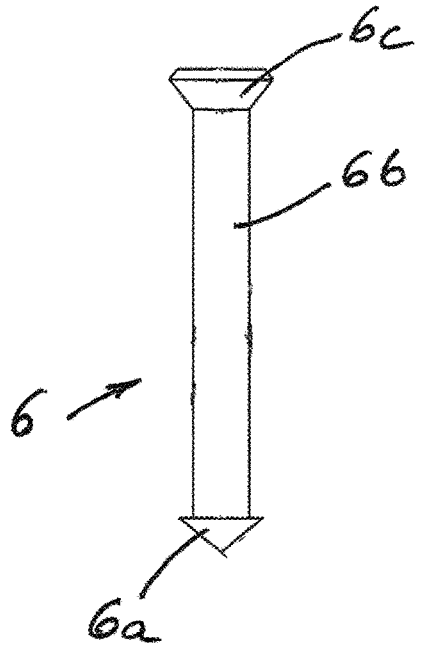
FIG. 3 shows an enlarged view of the inserted closure piston from FIG. 1*b*.

The closure piston 6 (FIG. 3) has a solid cylindrical shaft 6*b*, at one end of which a formation in the shape of a conical barb 6*a* made of a soft, flexible material is injection molded. At the end remote from the barb 6*a*, the shaft has a valve head 6*c* which is dimensioned such that the dispensing orifice is securely closed. According to the invention, the valve head is made of a soft, flexible material such that, when impinged by the flow of the medium that is to be dispensed, it is deformed and frees a "ring-shaped" gap for passage of the medium.

During assembly, this closure piston 6 has been inserted through the dispensing orifice into the second channel segment of the dispensing channel and has been anchored by means of barbs 6*a* in the region of the transition from the first to the second channel segment.

Figure 2:
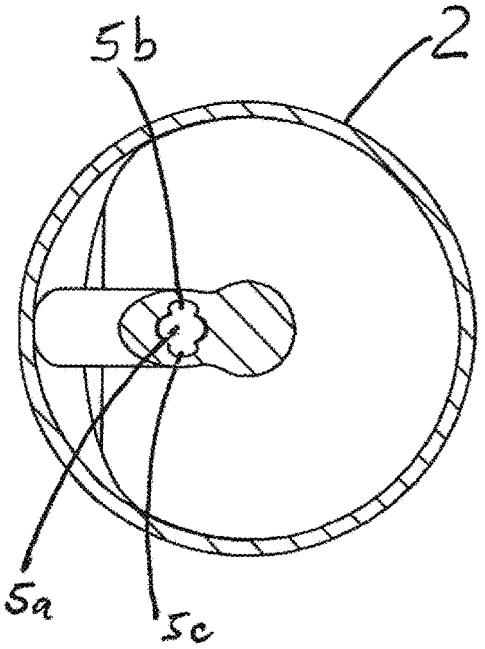
FIG. 2 shows a section along the axis B-B in FIG. 1*a*.

In the example shown, the shaft 6*b* of the channel segment 6 almost completely fills the second channel segment. FIG. 2 shows a cross section through the second channel segment 5. In the example shown, which represents a preferred embodiment, the second channel segment 5 has a cylindrical channel 5*a*, which is flanked by two cylindrical channels 5*b* and 5*c* of smaller diameter. The flanking channels 5*b* and 5*c* form the part of the second channel segment 5 through which the medium can flow from the first channel segment 4 to the dispensing orifice 3 when the closure piston 6 is inserted. By way of example, the figure shows two flanking channels, but in an advantageous embodiment of the invention it is expedient to use up to ten flanking channels, depending on the flow behavior of the medium. The opening of the dispensing orifice and the associated dispensing of the product from the dispensing head 1, and the subsequent re-closing of the dispensing orifice, are achieved by the elastic deformation of the valve head 6*c*, by virtue of the fact that the medium being conveyed builds up a hydraulic pressure in the dispensing channel.

By actuation of the dispensing head 1, the container valve is opened and medium flows from the container through the valve and the first channel segment 4 into the fine auxiliary channels 5*b* and 5*c* of the second channel segment. In this process, the shaft of the closure piston is not moved from its position, and instead the product flows laterally with respect to the shaft inside the fine channels 5*b* and 5*c* as far as the end where the second channel segment in which the valve head 6*c* sits merges into the dispensing orifice.

Inside the second channel segment 5, the system pressure increases on account of the product and acts perpendicularly with respect to the circumferential surface of the valve head 6*c*. Through the elasticity of the valve head 6*c*, the latter reacts with a slight deformation, as a result of which the cross section of the base of the truncated cone decreases. The surface fit between valve head 6*c* and dispensing orifice 3 is canceled, and a ring-shaped gap is produced through which the product can flow out. When the pressure inside the channel and against the circumferential surfaces of the valve head subsides, the valve head returns to its starting position and seals off the dispensing orifice again by means of the corresponding surface fit.

According to the invention, the shaft 6*b* of the closure piston 6 is also provided with ribs or grooves applied along the main axis, such that the medium can flow through the channel segment 5. This represents an alternative to the flanking channels. However, in the case of more viscous media, it may be expedient to use both flanking channels and also grooves in the shaft.

What is claimed is:

1. A self-closing dispensing head for a pressurized container, wherein the dispensing head comprises a dispensing valve for dispensing media, which dispensing valve comprises a dispensing orifice closeable by a closure element, an opening mechanism by which, in an assembled state, the dispensing orifice can be opened, and a channel for the media that opens into the dispensing orifice, wherein the channel comprises at least a first channel segment and a second channel segment and wherein, by pressure on an actuation element, the opening mechanism is actuated and the closure element, or a part of the closure element, and the second channel segment are moved relative to each other in such a way that a fluid passage is opened at the dispensing orifice to allow a flow of media from the container through the first and second channel segments and through and out of the dispensing orifice, the closure element being configured as a movable closure piston comprising a stiff cylindrical shaft with at one end at least one element for securing the closure piston in the second channel segment and/or at a transition from the first channel segment to the second channel segment, and the cylindrical shaft, at an end remote from the securing element, comprising a valve head which is dimensioned such that the dispensing orifice is securely closed, and wherein the closure piston is moved exclusively by hydraulic pressure, built up in the dispensing channel, of the media that is to be dispensed, and wherein (i) the closure piston comprises, on the cylindrical shaft of the closure piston, ribs or grooves oriented along a main axis of the cylindrical shaft; and/or (ii) the second channel segment comprises one or more notches and/or grooves along a main axis of the second channel segment, which notches and/or grooves increase a passage cross section of the dispensing channel; and/or (iii) starting from the first channel segment, one or more channel elements of smaller cross section than the second channel segment are arranged parallel to the second channel segment and open into the second channel segment before the dispensing orifice or open into the dispensing orifice.

2. The self-closing dispensing head of claim 1, wherein the closure piston comprises, on the cylindrical shaft of the closure piston, ribs or grooves oriented along a main axis of the cylindrical shaft.

3. The self-closing dispensing head of claim 1, wherein the second channel segment comprises one or more notches and/or grooves along a main axis of the second channel segment, which notches and/or grooves increase a passage cross section of the dispensing channel.

4. The self-closing dispensing head of claim 1, wherein starting from the first channel segment, one or more channel elements of smaller cross section than the second channel segment are arranged parallel to the second channel segment and open into the second channel segment before the dispensing orifice or open into the dispensing orifice.

5. The self-closing dispensing head of claim 1, wherein the second channel segment has a length of from 3 mm to 25 mm.

6. The self-closing dispensing head of claim 1, wherein the second channel segment has a length of from 5 mm to 20 mm.

7. The self-closing dispensing head of claim 1, wherein the elements for securing the closure piston in the dispensing channel comprise one or more barbs.

8. The self-closing dispensing head of claim 1, wherein the closure piston is constructed from different materials, the securing elements and the valve head consisting of a material that is more easily deformable than a material from which the cylindrical shaft is made.

9. The self-closing dispensing head of claim 8, wherein the valve head is made of one or more of a thermoplastic elastomer (TPE), silicone or low-density polyethylene (LDPE).

10. The self-closing dispensing head of claim 8, wherein the cylindrical shaft is made of one or more of acrylonitrile-butadiene-styrene terpolymer (ABS), polypropylene (PP) or polyoxymethylene (POM).

11. The self-closing dispensing head of claim 9, wherein the cylindrical shaft is made of one or more of acrylonitrile-butadiene-styrene terpolymer (ABS), polypropylene (PP) or polyoxymethylene (POM).

12. The self-closing dispensing head of claim 1, wherein the closure piston is produced by multi-component injection molding.

13. The self-closing dispensing head of claim 11, wherein the closure piston is produced by multi-component injection molding.

14. The self-closing dispensing head of claim 1, wherein the dispensing head is capable of dispensing viscous products.

15. The self-closing dispensing head of claim 1, wherein the dispensing head is capable of dispensing self-foaming products.

16. The self-closing dispensing head of claim 1, wherein the dispensing head is capable of dispensing gel-like products.

17. A pressurized container, wherein the container comprises the self-closing dispensing head of claim 1.

18. The container of claim 17, wherein the container contains a viscous product.

19. The container of claim 17, wherein the container contains a self-foaming product.

20. The container of claim 17, wherein the container contains a gel-like product.

* * * * *